United States Patent [19]

Leisch

[11] Patent Number: 4,855,546

[45] Date of Patent: Aug. 8, 1989

[54] VACUUM OPERATED CIRCUIT BREAKER

[76] Inventor: Lee J. Leisch, 433 Valencia Rd., Venice, Fla. 33595

[21] Appl. No.: 26,731

[22] Filed: Mar. 17, 1987

[51] Int. Cl.[4] ..... H01H 33/66

[52] U.S. Cl. ..... 200/144 B; 200/148 F

[58] Field of Search ..... 200/148 F, 144 B

[56] References Cited

U.S. PATENT DOCUMENTS 4,064,383 12/1977 Barkan ..... 200/148 F 4,215,256 7/1980 Sakaguchi et al. ..... 200/148 F 4,429,199 1/1984 Pircher et al. ..... 200/148 F 4,593,165 6/1986 Steinemer ..... 200/148 F

*Primary Examiner*—Robert S. Macon

*Attorney, Agent, or Firm*—Gifford, Groh, Sheridan, Sprinkle and Dolgorukov

[57] ABSTRACT

A vacuum operated circuit breaker includes in combination, a frame carrying a vacuum operator and a support assembly supporting a plurality of links one of which connects to a plunger part of the vacuum operator whereby when the links are pivoted the plunger enters and retracts from the vacuum operator and makes and breaks an electric circuit.

12 Claims, 2 Drawing Sheets

VACUUM OPERATED CIRCUIT BREAKER

BACKGROUND OF THE INVENTION

1. Field:

The present invention relates to electrical switchgear of the type used in electrical generating stations and, more particularly, to circuit breakers for installation in such generating stations.

2. Prior Art:

Conventional circuit breaker switchgear comprises a removable and interrupting element as used in metal-clad switchgear that provides reliable control and protection of electrical apparatus and power systems.

Such conventional circuit breaker switchgear includes three similar pole units, each of which includes current carrying parts, main and arcing controls, interrupter, and an enclosing barrier system that provides insulation between poles, or phases and to ground.

Operating mechanisms of conventional circuit breakers operate on A-C or D-C voltage, and closing and opening operations are controlled either electrically from the metal-clad unit and remote location, or mechanically by the manual close and trip levers on the breaker.

Such prior art mechanisms do wear out and when it is necessary to replace such units, many parts are not available and so cannot be replaced.

The equipment of the present invention replaces worn out conventional 5 and 15 KV air operated circuit breakers at a reasonable cost and with a minimum downtime to make the change-over to vacuum operated circuit breakers in accordance with the present invention.

The principal object of the present invention is to provide a vacuum operated circuit breaker for the reconstruction of a majority of the existing older medium voltage and high voltage, say in the 5 and 15 KVA range of obsolete, air-operated switchgear installations at a reasonable cost.

How this object and others that persons skilled in the art will recognize are accomplished will become apparent from the following description and drawing illustrating a preferred embodiment of the present invention.

SUMMARY OF THE INVENTION

A vacuum operated circuit breaker includes the combination of a frame carrying a vacuum operator; a support assembly pivotally supporting a plurality of links one of which connects to a plunger part of the operator whereby when the links are pivoted, the plunger enters and retracts from the vacuum operator and makes and breaks an electrical circuit.

The many objects and advantages of the present invention will become apparent to those skilled in the art when the following description of the best modes contemplated at present for practicing the invention is read in conjunction with the accompanying drawing, wherein like reference numerals refer to like or equivalent parts.

DETAILED DESCRIPTION OF THE PREFERRED EMBODIMENT

Figure 2:
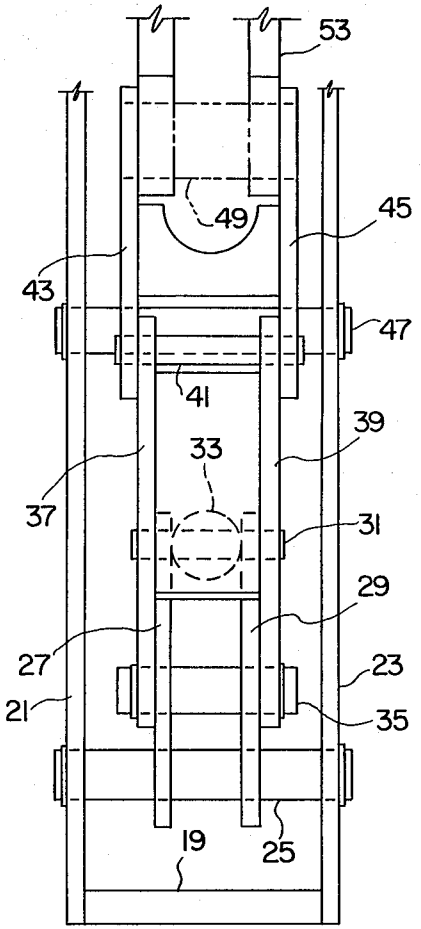
FIG. 2 is a view along line II—II of FIG. 1.
Figure 1:
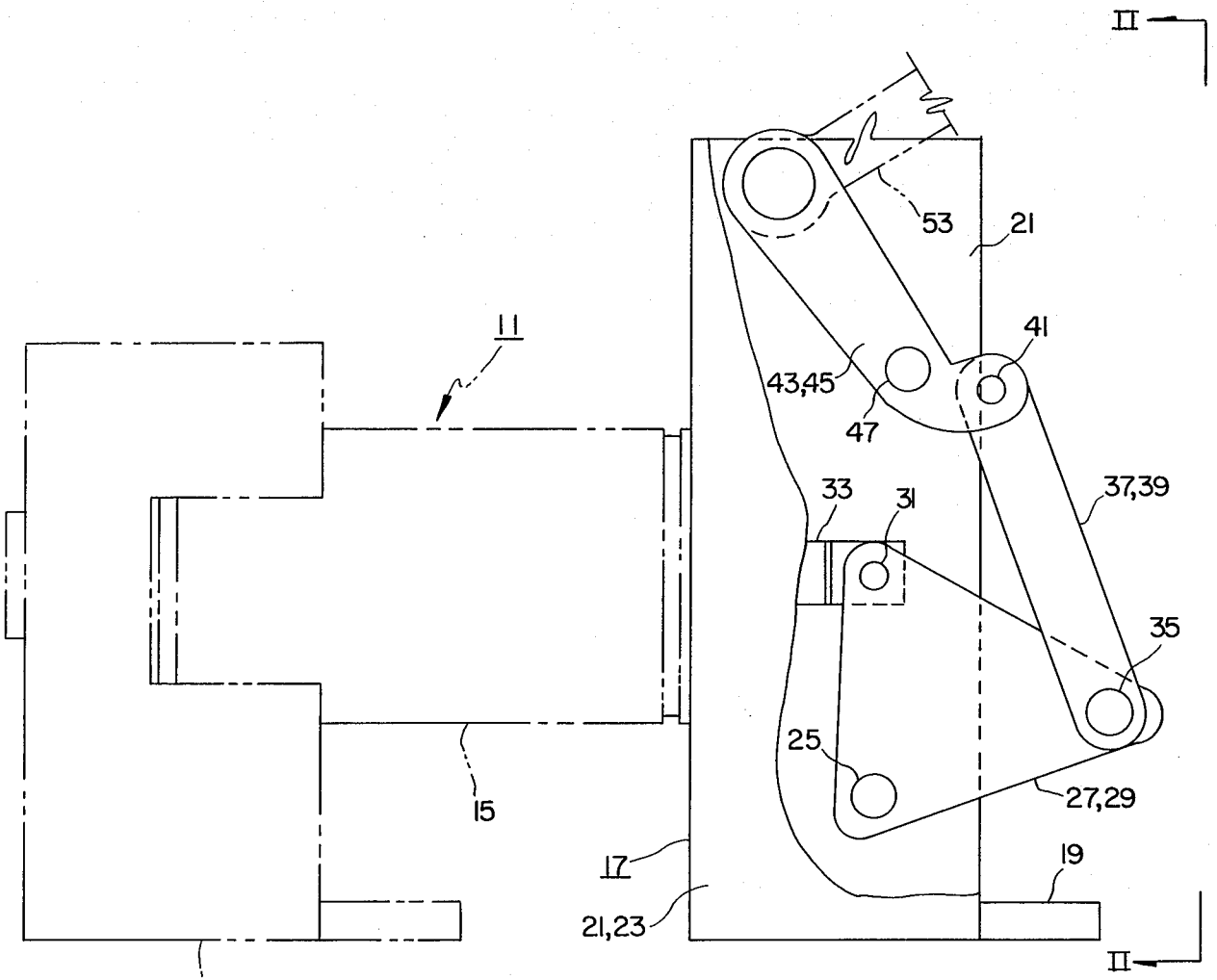
FIG. 1 shows schematically an improved vacuum operated circuit breaker in accordance with the present invention showing it in one operator position.

Referring to FIG. 1, a vacuum operated switchgear mechanism 11, shown in the closed position, comprises a frame 13 that supports a vacuum switch 15; one such vacuum switch being a type manufactured and sold by ITT Jennings of San Jose, Calif.

Figure 3:
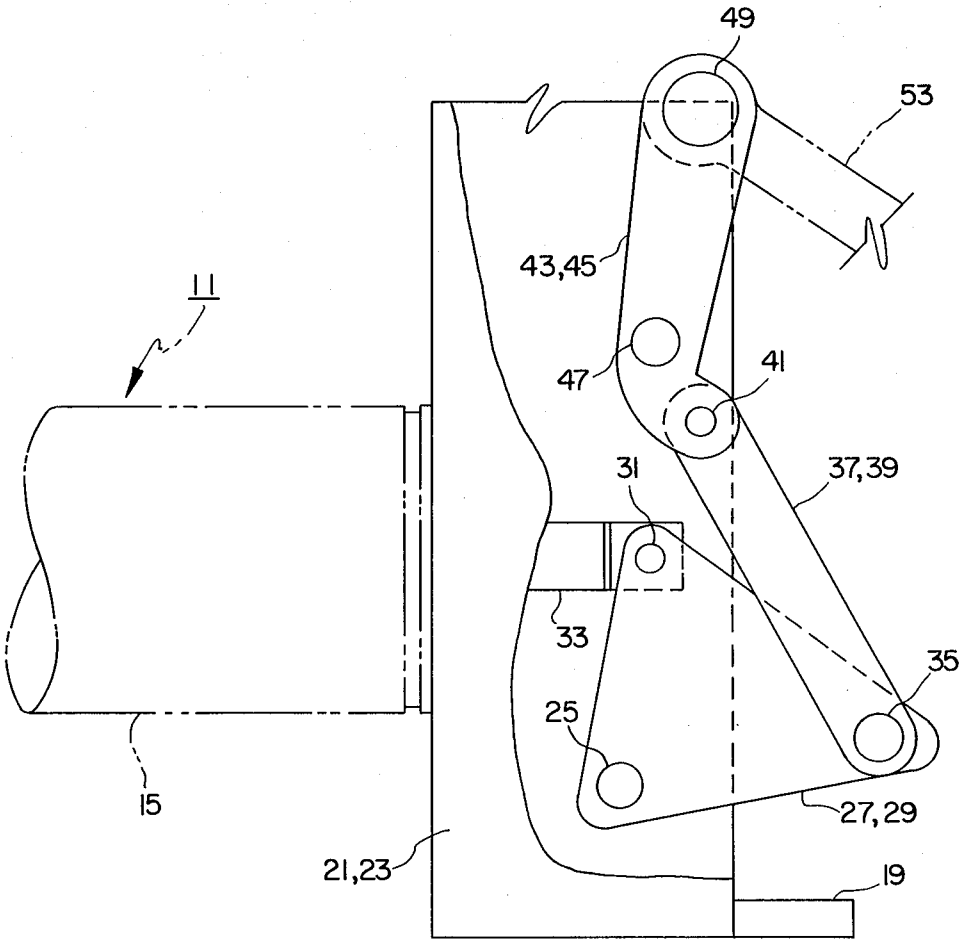
FIG. 3 is a view similar to that of FIG. 1, but showing the vacuum operated circuit breaker in another operator position.

FIG. 3 shows the apparatus of the present invention in the closed or contact position. The vacuum switch 15 has one end that is carried by the frame 13 which is mounted to existing support structure (not shown) of conventional switchgear installations. The other end of the vacuum switch 15 is mounted to a support assembly 17 that becomes a conductor part of the transistion of units.

The vacuum switch 15 contains two electrical contacts; a fixed contact and a movable contact with both contacts being in a vacuum within the switch. Since the electrical resistance of a vacuum is nearly infinite, only a very small contact gap is needed in high voltage installations. Such a vacuum, because of its high, or nearly infinite, resistance for small contact gaps, is ideal for the opening and closing of high current, high voltage circuits. The problem of arc suppression and contact erosion is greatly eliminated and cost is greatly reduced.

By thus installing a vacuum operated circuit breaker in place of the old conventional air-operated switch units, the life of circuit breakers is extended considerably.

The support assembly 17 includes a base plate 19 having two upstanding, generally rectangular side plates 21,23. Between the two generally rectangular side plates 21,23 extends a pin 25 that carries two triangular shaped plates 27,29. The pin 25 is located at a corner of the plates 27,29 and they pivot about the axis of the pin 25.

At another apex position of the triangular shaped plates 27,29, a pin 31 extends between the plates 27,29 and it is connected to a plunger 33 extending out from the vacuum switch 15. At the other apex of the triangular plates 27,29, a pin 35 extending therebetween carries a pair of links 37,39. These links 37,39 carry at their upper end positions a pin 41 that carries on its ends links 43,45 that are pivotally connected to the generally rectangular side plates 21,23 by means of a pin 47.

The links 43,45 have a shape about like that shown in FIG. 1, and they are pivotally connected by a pin 49 to a forked operative arm 53 such as exists at existing equipment. The arm 53 moves the links 43, 45 and movement of the links 43, 45, pivoting about the pin 47, includes pivotal movement of the plates 27, 29 through the links 37, 39. When the plates 27, 29 pivot about the pin 25 the plunger 33 moves either into or out of the vacuum switch 15 and an electrical circuit is interrupted or is connected. The linear travel of the plunger 33 is of the order of magnitude of five-sixteenths to one-half inch.

From the foregoing description of a preferred embodiment of the present invention, those skilled in the art will recognize many features and advantages thereof, among which the following are particularly significant:

That the vacuum operated circuit breaker of the present invention effectively reduces the stroke travel of the contact elements from two to four inches in prior art, existing equipment to five-sixteenths to one-half inch;

That the vacuum operated circuit breaker of the present invention is useful in replacing worn out, older switchgear in medium and high voltage power installations.

That the apparatus of the present invention is readily adapted for installation in existing switchgear for which parts are not available; and That the apparatus of the present invention is available at much lower cost than new equipment to replace switchgear in existing old power installations.

Having thus described the present invention by way of an example with a certain degree of particularity, it is understood that modifications may be made thereto without departing from the scope thereof as defined by the following claims.

What is claimed is:

1. An electrical vacuum switch assembly comprising, in combination:

a frame;

a vacuum switch operator affixed to said frame, said operator including a moveable plunger such that movement of said plunger makes and breaks an electric circuit;

a pair of parallel plates pivotally mounted to said frame about a first axis and pivotally mounted to said plunger, whereby pivoting of said plates about said first axis moves said plunger;

a pair of parallel first links pivotally mounted to said frame about a second axis;

a pair of parallel second links pivotally connected to said pair of first links and pivotally connected to said pair of parallel plates; and an operative arm pivotally connected to said pair of first links such that movement of said arm causes said pair of first links to pivot about said second axis, thereby moving said pair of second links and causing said pair of plates to pivot about said first axis, thereby moving said plunger.

2. The assembly of claim 1, wherein said parallel plates are triangular.

3. The assembly of claim 1, further comprinsing a pin mounted to said parallel plates and journalled to said plunger.

4. The assembly of claim 1, wherein said operating arm is part of a previously existing electrical ciruit breaker.

5. The assembly of claim 1, wherein the movement of said plunger caused by movement of said operative arm is about 5/16 to ½ inch.

6. The assembly of claim 1, further comprising a pin mounted to said frame about which said plates pivot.

7. The assembly of claim 1, further comprising a pin mounted to said plates about which said pair of second links pivot.

8. The assembly of claim 1, further comprising a pin mounted to said frame about which said pair of first links pivot.

9. The assembly of claim 1, further comprising a pin mounted to said pair of second links about which said pair of first links pivot.

10. The assembly of claim 1, wherein said first and second axes are parallel and fixed in position with respect to said frame.

11. The assembly of claim 1, wherein said first and second axes are parallel and are spaced from one another.

12. The assembly of claim 1, wherein said first and second axes are spaced from one another and are -fixed in position with respect to said frame.

* * * * *